US007036691B2

(12) United States Patent
Nicolas

(10) Patent No.: US 7,036,691 B2
(45) Date of Patent: May 2, 2006

(54) DISPENSER DEVICE FOR FITTING TO A RECEPTACLE PROVIDED WITH A VALVE

(75) Inventor: Albisetti Nicolas, Clichy (FR)

(73) Assignee: L'Oreal, Paris (FR)

( * ) Notice: Subject to any disclaimer, the term of this patent is extended or adjusted under 35 U.S.C. 154(b) by 88 days.

(21) Appl. No.: 10/443,986

(22) Filed: Sep. 8, 2003

(65) Prior Publication Data

US 2004/0112924 A1 Jun. 17, 2004

(30) Foreign Application Priority Data

May 24, 2002 (FR) ..... 02 06362

(51) Int. Cl.
*B65D 88/54* (2006.01)

(52) U.S. Cl. ..... 222/321.6; 222/182; 222/402.13; 222/153.11

(58) Field of Classification Search ..... 222/402.13, 222/402.12, 402.14, 402.1, 182, 380, 321.3, 222/321.6, 321.7, 321.9, 321.8, 402.11, 383.1, 222/562, 385, 527–529, 153.11, 153.13, 153.14, 222/406, 402.15

See application file for complete search history.

(56) References Cited

U.S. PATENT DOCUMENTS

| | | | | | |
|---|---|---|---|---|---|
| 3,178,077 | A | * | 4/1965 | Benedetto | 222/402.13 |
| 3,227,321 | A | * | 1/1966 | Sagarin | 222/402.13 |
| 3,253,749 | A | * | 5/1966 | Sagarin | 222/182 |
| 3,254,677 | A | * | 6/1966 | Wakeman | 137/630.22 |
| 3,540,624 | A | * | 11/1970 | Green | 222/108 |
| 3,680,738 | A | * | 8/1972 | Vos et al. | 222/54 |
| 3,940,025 | A | * | 2/1976 | Anderson | 222/182 |
| 3,958,726 | A | * | 5/1976 | Trotta | 222/402.13 |
| 3,967,760 | A | * | 7/1976 | Marcon | 222/153.11 |
| 4,053,090 | A | * | 10/1977 | Kelly et al. | 222/402.13 |
| 4,067,482 | A | * | 1/1978 | Vogel et al. | 222/153.11 |
| 4,166,554 | A | * | 9/1979 | Anderson | 222/182 |
| 5,027,982 | A | * | 7/1991 | Demarest | 222/182 |
| 5,649,645 | A | * | 7/1997 | Demarest et al. | 222/153.07 |
| 6,062,432 | A | * | 5/2000 | Estrada | 222/153.12 |
| 6,089,410 | A | * | 7/2000 | Ponton | 222/183 |
| 6,145,704 | A | * | 11/2000 | Geier | 222/153.06 |
| 6,302,302 | B1 | * | 10/2001 | Albisetti | 222/153.11 |

FOREIGN PATENT DOCUMENTS

| | | |
|---|---|---|
| CH | 422168 | 2/1968 |
| EP | 0151873 | 8/1985 |
| EP | 0151973 | 8/1985 |
| EP | 1118554 | 7/2001 |
| FR | 1572537 | 6/1969 |
| FR | 2767799 | 5/1999 |
| FR | 2814726 | 5/2002 |
| WO | WO97/25259 | 7/1997 |

OTHER PUBLICATIONS

French Preliminary Search Report dated Jan. 24, 2003.

* cited by examiner

*Primary Examiner*—Frederick C. Nicolas
(74) *Attorney, Agent, or Firm*—Oliff & Berridge, PLC

(57) ABSTRACT

The present invention relates to a dispenser device having: a cover; a dispenser endpiece, the dispenser endpiece having a dispenser orifice and a duct for channeling the substance flowing out from the dispenser element towards the dispenser orifice; and a pushbutton movable relative to the cover. The pushbutton is configured so that when actuated to dispense the substance, it in a first stage moves the dispenser orifice relative to the cover in such a manner as to bring it into register with the opening of the cover, the duct of the dispenser endpiece being suitable for deforming so as to enable the dispenser orifice to be moved without actuating the dispenser element during this first stage; and thereafter, in a second stage, it actuates the dispenser element.

21 Claims, 6 Drawing Sheets

DISPENSER DEVICE FOR FITTING TO A RECEPTACLE PROVIDED WITH A VALVE

RELATED APPLICATIONS

This application claims priority to French Patent Application No. 02 06362 filed May 24, 2002, which is incorporated herein by reference.

FIELD OF THE INVENTION

The present invention relates to dispenser devices.

BACKGROUND OF THE INVENTIONS.

A dispenser device is known from FR-A-2 814 726, but is suitable for operating only with a valve that enables the rod of the valve to be depressed over a considerable stroke prior to triggering dispensing of the substance.

However, there exist numerous pressurized receptacles that are fitted with valves that require the valve rod to travel over a short stroke only in order to cause the substance to be dispensed, and as a result the device described in FR-A-2 814 726 is unsuitable for use with such receptacles.

Other dispenser devices are known from WO 97/25259, EP-A-1 118 554, FR-A-2 767 799, EP-A-0 151 973, CH 422 168, and FR 1 572 537.

The device described in FR 1 572 537 uses a metal spring to act on the dispenser endpiece, but that feature is relatively expensive.

OBJECTS AND SUMMARY OF THE INVENTION

The present invention relates to a dispenser device comprising: a cover or "collar" for fixing on the receptacle, the cover presenting an opening; a dispenser endpiece movable relative to the cover, wherein the dispenser endpiece comprises a dispenser orifice and a duct for conveying the substance flowing out from the dispenser element towards the dispenser orifice; and a pushbutton movable relative to the cover to act on the dispenser endpiece in order to actuate the dispenser element, the cover being configured firstly to mask the dispenser orifice when the pushbutton is at rest, and secondly to enable the dispenser orifice to take up a position facing the opening of the cover when the pushbutton is depressed in order to actuate the dispenser element, i.e., to dispense the substance. The device can be fitted to a receptacle.

The invention seeks in particular to enable a dispenser device of the above-mentioned type to be used with a valve that requires the valve rod to move only a short distance in order to cause the substance to be dispensed.

In one of its aspects, the invention provides a device in which the pushbutton is configured so that when actuated to dispense the substance it acts in a first stage to move the dispenser orifice relative to the cover in such a manner that it comes into register with the opening of the cover, the duct of the dispenser endpiece being suitable for deforming so as to enable the dispenser orifice to move without actuating the dispenser element during this first stage, and thereafter, in a second stage, it actuates the dispenser element.

The invention makes it possible to provide at relatively low cost a reliable dispenser device that can be used with a dispenser, element, such as a valve or a pump, that requires only a small displacement of a control rod in order to cause the substance to be dispensed.

In a particular embodiment of the invention, the dispenser endpiece may comprise: a peripheral portion relative to which the dispenser orifice is stationary; a central portion co-operating with the dispenser element; and an elastically deformable intermediate portion interconnecting the central and peripheral portions.

The intermediate portion may comprise flexible bridges of material, and the duct may advantageously be made at least in part inside one of the bridges.

At least one of the bridges may present a right section that is substantially rectangular, having a long side substantially perpendicular to a displacement direction of the dispenser endpiece for actuating the dispenser element. In one embodiment, the displacement direction may optionally coincide with a longitudinal axis of a valve rod.

In another embodiment, the intermediate portion may comprise three bridges disposed substantially at 120° from one another.

In another embodiment, the pushbutton may be configured so as to entrain displacement of the peripheral portion during the above-mentioned first stage without entraining the central portion, and then during the second stage, to entrain the central portion also.

The force exerted by the intermediate portion on the central portion when the pushbutton begins to be released while the dispenser element is still in the dispensing position may be smaller than the force exerted by the dispenser element on the central portion in order to return each of the dispenser components to their initial states.

The central portion, the intermediate portion, and the peripheral portion may be made as a single piece of molded material, using a single material or a plurality of materials, for example using a thermoplastic elastomer for the bridges of material interconnecting the central and peripheral portions.

On its push-button side, the peripheral portion may include at least one stiffening rib oriented obliquely inwards. The pushbutton may have a skirt configured to press via its free edge on an abutment surface situated radially outside the rib.

In a preferred embodiment, the central portion may include a projecting element beside the pushbutton, and the pushbutton may have an inner skirt in which it can engage said projecting portion, the inner skirt being configured to cause its free edge to press against an abutment surface of the central portion, surrounding the projecting element.

The dispenser orifice may be defined by a nozzle having swirling channels, for example.

The dispenser endpiece may have a wall suitable for taking up a position facing the opening of the cover when the pushbutton is at rest.

The dispenser element may have a control rod, where such a control rod is referred to as a valve rod when the dispenser element is a valve.

In another of its aspects, the invention also provides a receptacle fitted with a dispenser device as defined above.

The receptacle may include a valve having a valve rod through which the substance is dispensed when the valve is actuated. The axial displacement of the valve rod needed for actuating the valve may be no greater than 2 millimeters (mm), for example.

BRIEF DESCRIPTION OF THE DRAWINGS

The invention will be better understood on reading the following detailed description of non-limiting embodiments, and on examining the accompanying drawings.

MORE DETAILED DESCRIPTION

Figure 3:
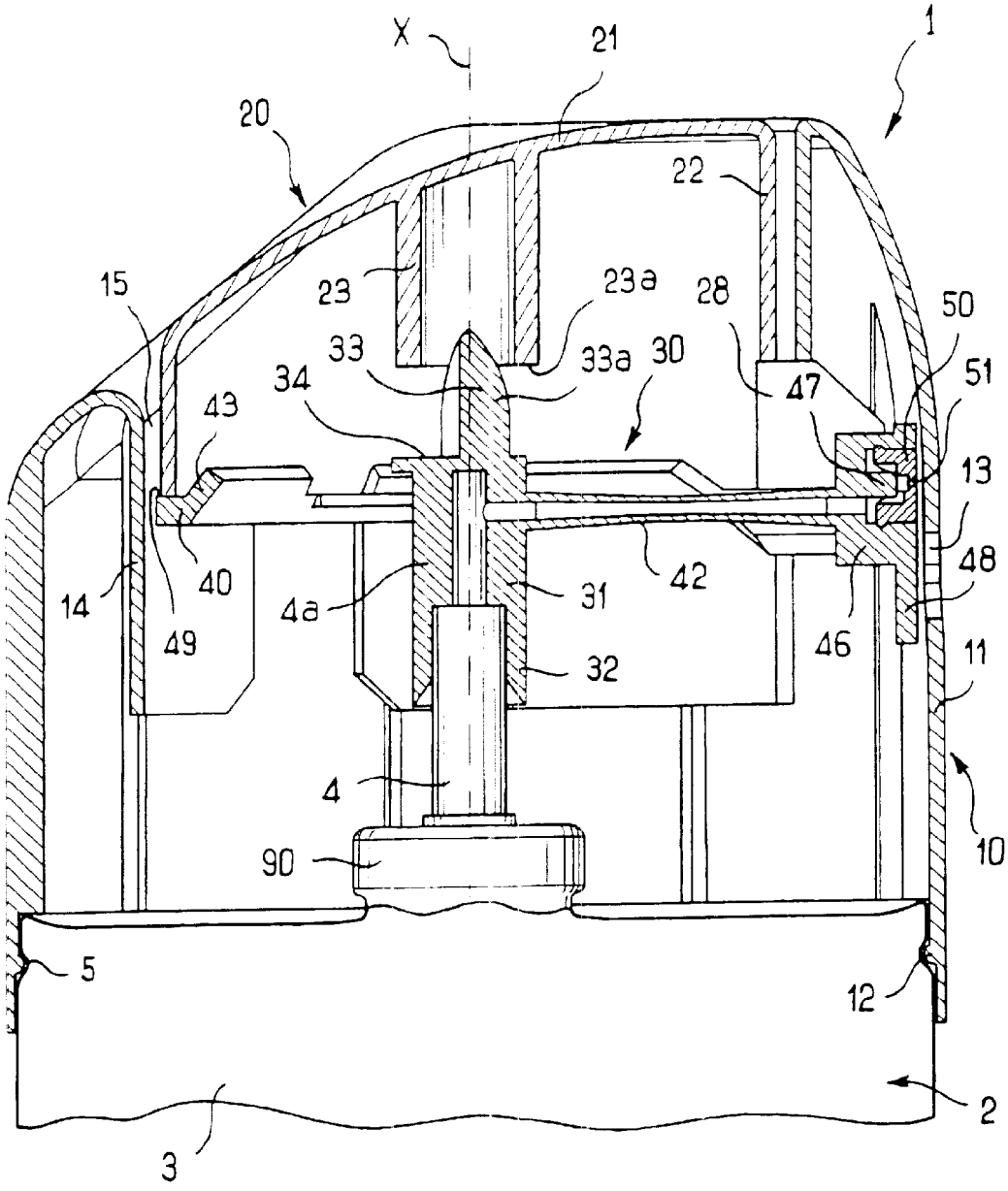
FIG. 3 is a diagrammatic axial section view of the FIG. 1 device in place on a receptacle, the pushbutton not being depressed.
Figure 4:
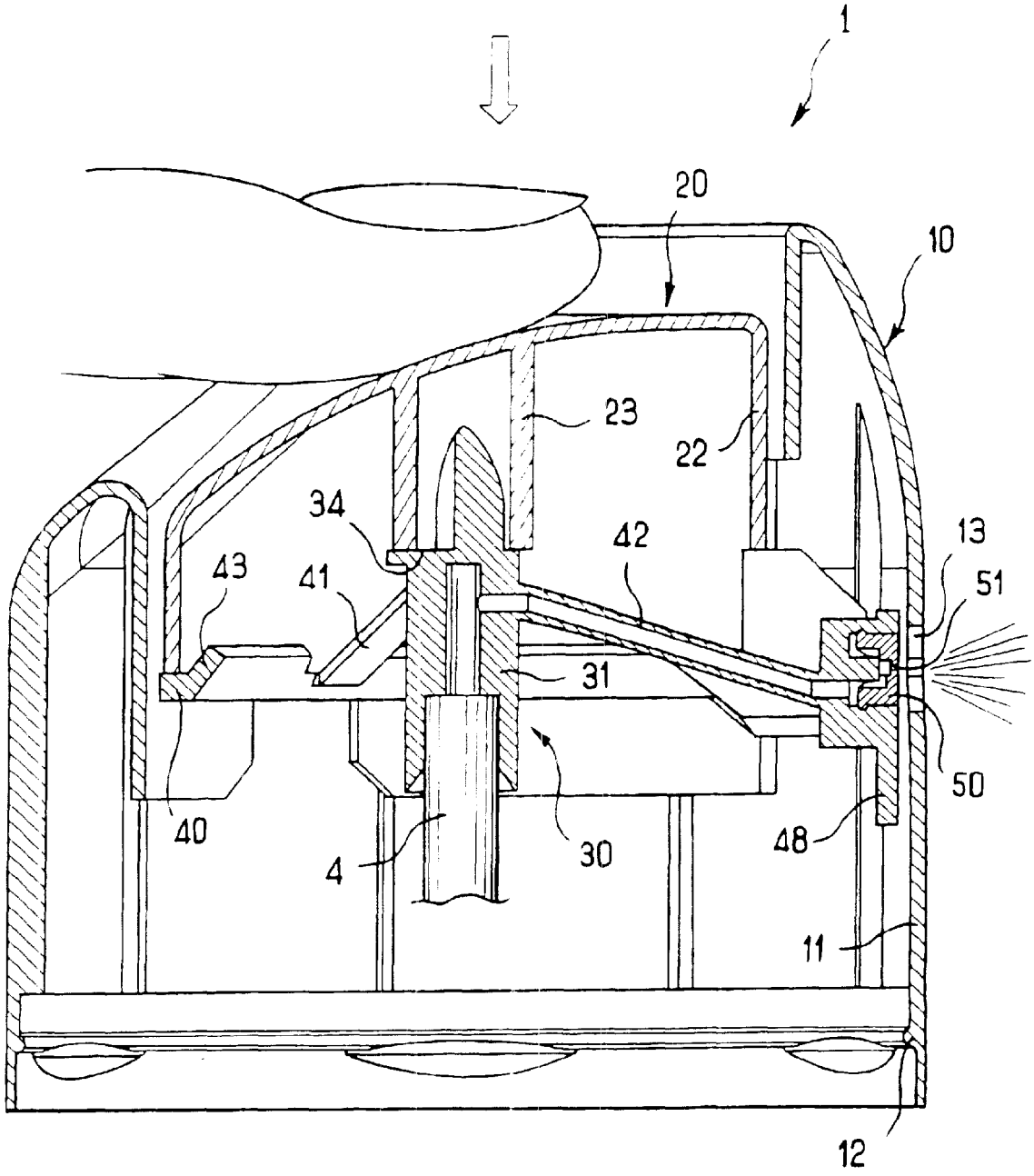
FIG. 4 is a view analogous to FIG. 3, showing the device while it is dispensing.

The drawings show a dispenser device 1 for fitting on a receptacle 2, the receptacle being shown in part in FIGS. 3 and 4.

In one embodiment, the receptacle 2 comprises a pressurized can 3 provided with a valve 90 crimped in a cup closing the top portion of the can 3 in a conventional manner, the valve 90 having a hollow valve rod 4.

The valve may be of any known type, with actuation being performed, in one embodiment, by depressing the rod 4 over a stroke of not more than 2 mm.

The receptacle 2 may contain a substance for spraying, e.g. a cosmetic, together with a propellent gas, which may optionally be stored in liquefied form in the receptacle 2 and may optionally be delivered together with the substance.

The dispenser device 1 comprises a cover 10, a pushbutton 20, and a dispenser endpiece 30.

The cover 10 has an assembly skirt 11 provided at its bottom end with a bead 12 suitable for snap-fastening in an annular groove 5 present near the top of the can 3.

The assembly skirt 11 is pierced by an opening 13 through which the substance can be dispensed when the pushbutton 20 is depressed, as shown in FIG. 4.

In one embodiment, the opening 13 is generally circular in shape, as shown.

The top of the assembly skirt 11 is connected to an inner skirt 14 which defines an opening 15 giving access to the pushbutton 20. The pushbutton comprises a top wall 21 for being pressed by a user's finger, connected at its periphery to a first skirt 22 extending at least partially in register with the inner skirt 14 of the cover 10.

Inside the first skirt, the pushbutton 20 has a second skirt 23 that is circularly cylindrical and of substantially the same axis X as the valve rod 4.

Figure 1:
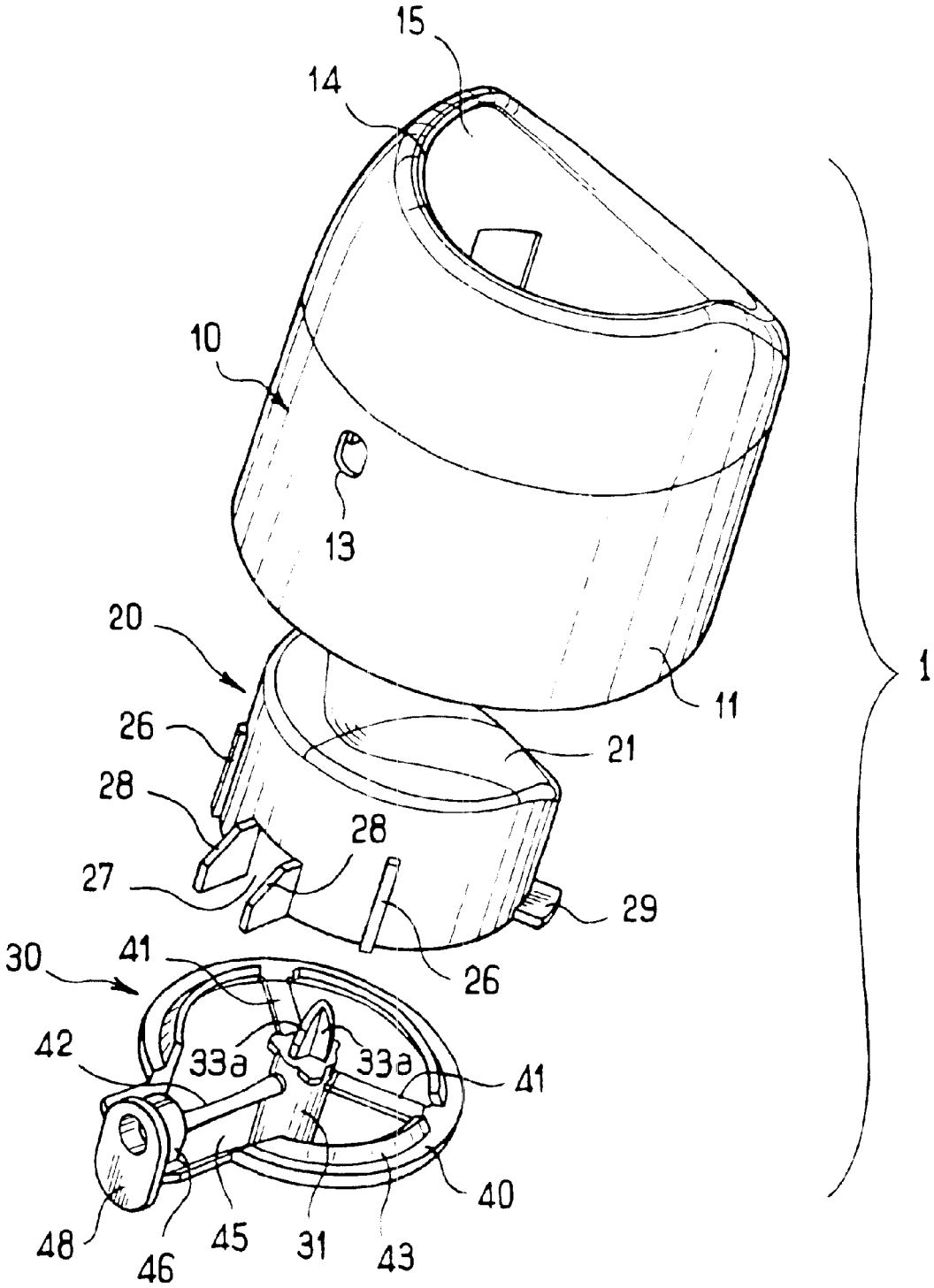
FIG. 1 is a diagrammatic exploded perspective view of a dispenser device made in accordance with the invention.

The outside of the first skirt 22 is provided with vertical splines 26 as can be seen in FIG. 1, and in its bottom portion it is provided with a lateral opening 27 between two vertical tabs 28 for pressing against the dispenser endpiece 30.

The pushbutton 20 also has a horizontal tab 29 designed to prevent it from escaping from the cover 10, by coming into abutment thereagainst.

The dispenser endpiece 30 comprises a central portion 31 having a bottom cylindrical skirt 32 defining a housing with a shoulder in which the top end of the valve rod 4 can be received in substantially leaktight manner, as can be see in FIG. 4. This figure also shows that the valve rod 4 comes into abutment at its top end 4*a* against the shoulder in the housing.

The top of the central portion 31 is provided with a projecting element 33 of generally pointed shape formed by three walls 33*a* disposed at 120° from one another.

In FIG. 4 in particular, it can be seen that the central portion 31 defines an abutment surface 34 around the base of the projecting element 33, the second skirt 23 of the pushbutton having a bottom end 23*a* that comes to bear thereagainst when the pushbutton 20 is depressed sufficiently.

In addition to the central portion 31, the dispenser endpiece 30 has a peripheral portion 40 of generally annular shape.

The central and peripheral portions 31 and 40 are connected together by bridges of spring-forming material, and in the example shown by two substantially radial arms 41 disposed at 120° to each other, together with a substantially radial duct 42 disposed at 120° to each of the arms 41.

Each arm 41 presents a right section that is generally in the form of a flat rectangle having a long side perpendicular to the axis X.

The duct 42 presents a right section that is generally circular in shape.

The peripheral portion 40 has an annular rib 43 extending obliquely inwards beside the pushbutton 20, being interrupted at the connections with the arms 41 and at a gap 45 disposed on either side of the duct 42.

The peripheral portion 40 has a nozzle support 46 to which the duct 42 is connected and on which it is possible to fix a conventional nozzle 50 having swirling channels, as can be seen in FIGS. 3 and 4. The support 46 is provided for this purpose with a stud or "centerpost" 46. The bottom of the support 46 has a wall 48 which takes up a position behind the opening 13 when the pushbutton 20 is at rest, thereby shutting it off, as can be seen in FIG. 2.

The nozzle 50 comprises a dispenser orifice 51.

In the example shown, the dispenser endpiece 30 is made as a single piece by molding plastic material(s). The material in which the dispenser endpiece 30 is made is selected in such a manner that the peripheral portion 40 can move axially relative to the central portion 41 by elastic deformation of the arms 41 and of the duct 42.

Figure 2:
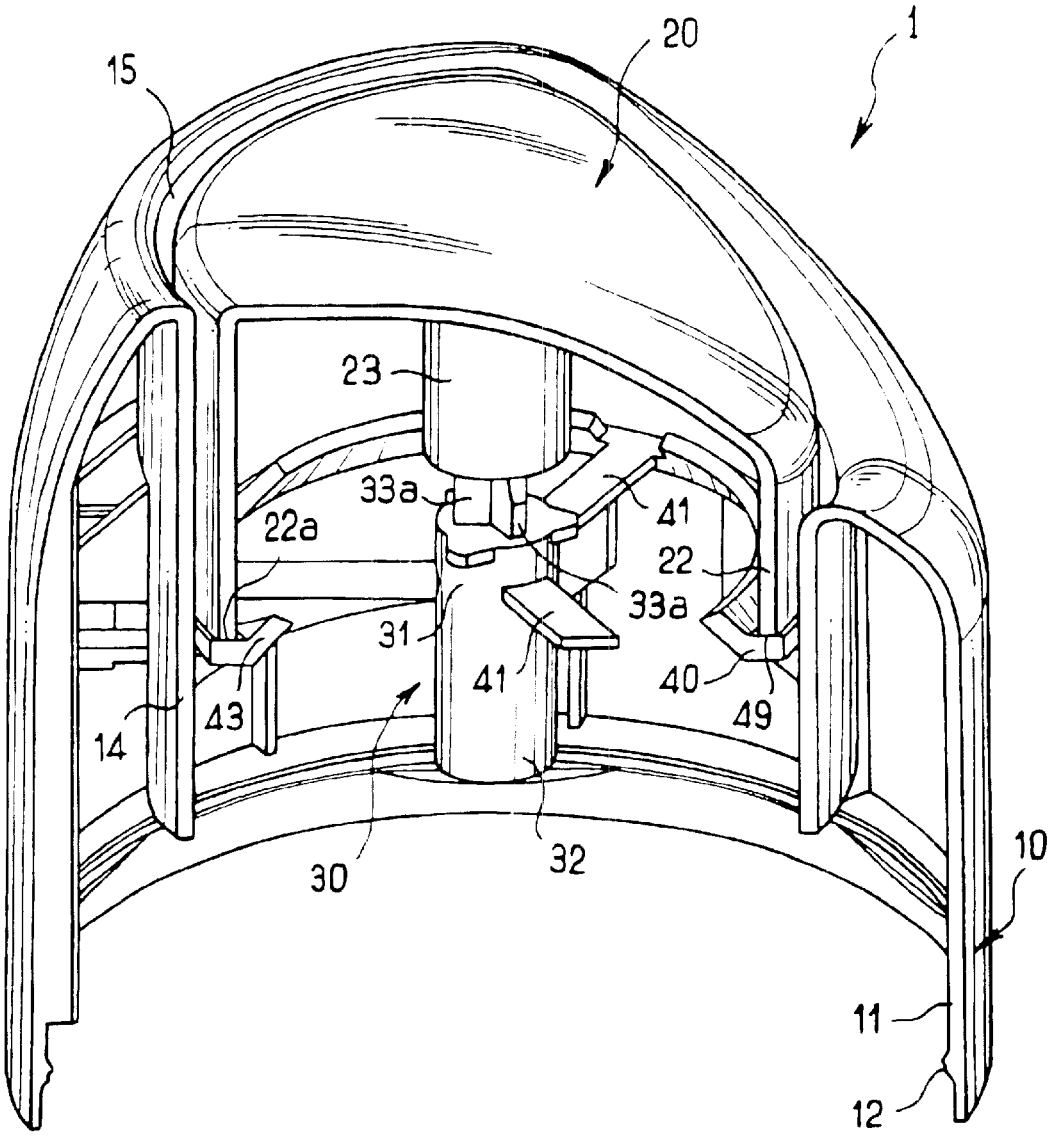
FIG. 2 is a cutaway diagrammatic perspective view of the FIG. 1 device in the assembled state.

Radially on the outside of the rib 43, the peripheral portion 40 defines an abutment surface 49 on which the first skirt 22 of the pushbutton 20 can press via its bottom end 22*a*, as can be seen in FIG. 2.

This figure also shows that when the pushbutton 20 is at rest, the first skirt 22 and the tabs 28 come substantially to bear against the peripheral portion 40, while the second skirt 23 is spaced apart from the abutment surface 34. The tabs 28 are positioned on either side of the duct 42.

The dispenser device 1 operates as follows.

At rest, the wall 48 is situated behind the opening 13 and prevents impurities from penetrating into the inside of the cover 10. The dispenser orifice 51 is protected by the portion of the wall 11 of the cover that is situated above the opening 13.

When the user presses the pushbutton 20 to dispense the substance, during an initial stage, the pushbutton 20 entrains the peripheral portion 40 in downwards movement, thereby causing the dispenser orifice 51 to be positioned facing the opening 13. During this movement of the peripheral portion 40, the valve rod 4 is moved little or substantially not at all, so the valve is not actuated, the force that needs to be exerted on the valve rod 4 to actuate the valve being greater than the force needed for moving the peripheral portion 40 relative to the central portion 31 in order to bring the dispenser orifice 51 into register with the opening 13.

Thereafter, when the end 23*a* of the skirt 23 of the pushbutton reaches the abutment surface 34, continued downward movement of the pushbutton 20 is accompanied by the valve rod 4 being depressed over a stroke that is sufficient to actuate the valve. The dispenser orifice 51 is situated at this time more or less in the center of the opening 13, and the substance contained in the receptacle 2 can leave the channel inside the valve rod 4, flow inside the central portion 31, and reach the duct 42 and then the nozzle 50.

During the movement of the peripheral portion 40 relative to the central portion 31, the duct 42 and the arms 41 are deformed elastically.

The force exerted by the arms 41 and the duct 42 on the central portion 31 when the pushbutton 20 begins to be released while the valve is still dispensing, is less than the force exerted by the valve rod 4 on the central portion 31 when it returns to its initial state.

Thus, when the user releases the pushbutton 20, the valve rod 4 can rise, and dispensing of the substance is interrupted, the skirt 22 still bearing against the peripheral portion 40.

As the return movement of the pushbutton 20 continues, contact between the central portion 31 and the second skirt 23 ceases and the peripheral portion 40 accompanies the return movement of the pushbutton 20, the wall 48 taking up its position behind the opening 13, and the dispenser orifice 51 again being protected by the cover 11.

Naturally, the invention is not limited to the embodiment described above.

By way of example, the dispenser element can be constituted by a valve that does not include a valve rod.

Figure 5:
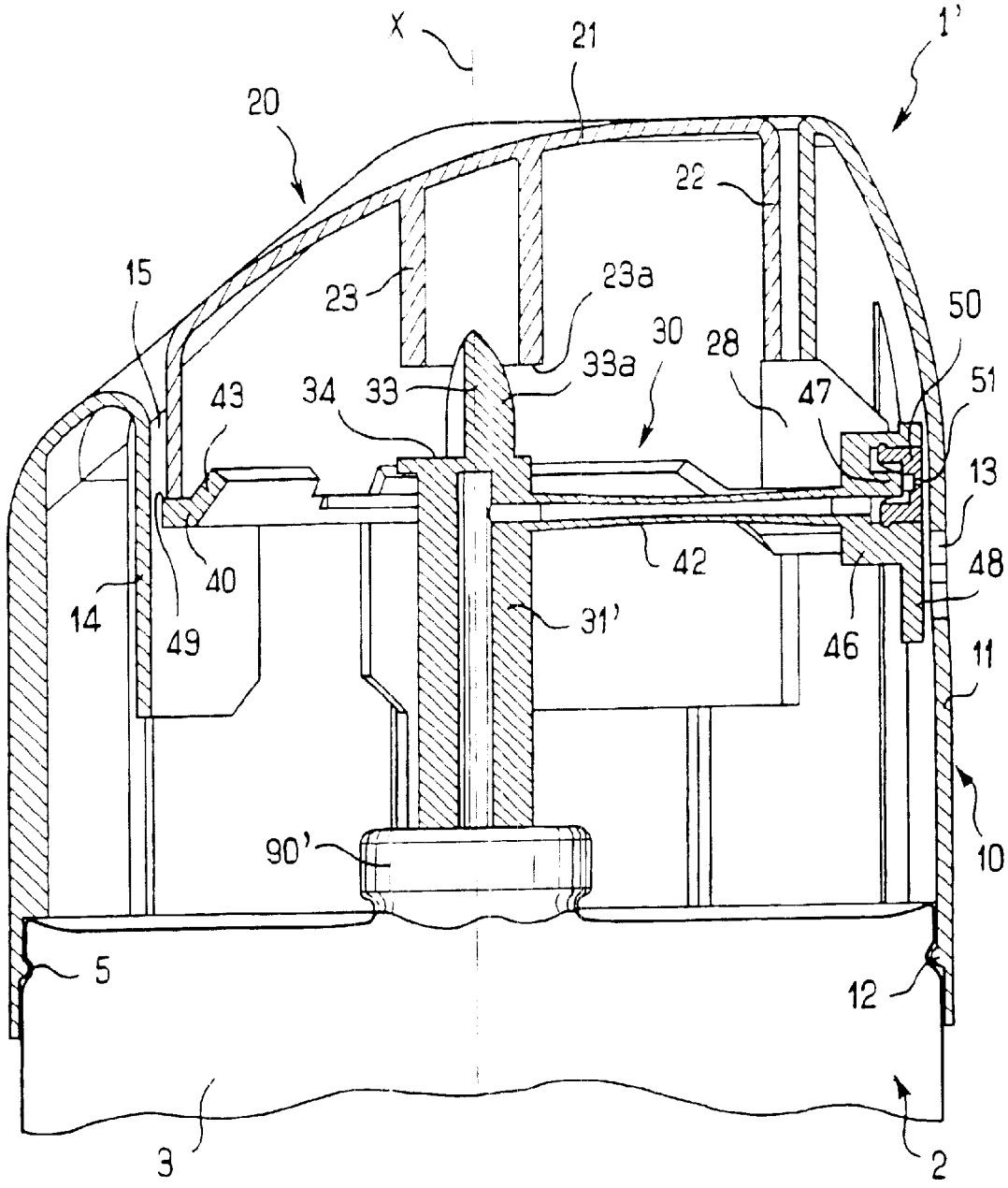
FIG. 5 is a view analogous to FIG. 3 showing a variant embodiment in which the dispenser element is a valve that does not have a valve rod.

By way of example, FIG. 5 shows a device 1' which differs from that described above with reference to FIGS. 1 to 4 by the fact that the valve 90' used is of the type that does not have a valve rod, the central portion 31 being replaced by a central portion 31' configured to press on a control member of the valve (not shown in the figure), in order to cause substance to be dispensed.

In another aspect of the invention, the dispenser element comprises a pump.

Figure 6:
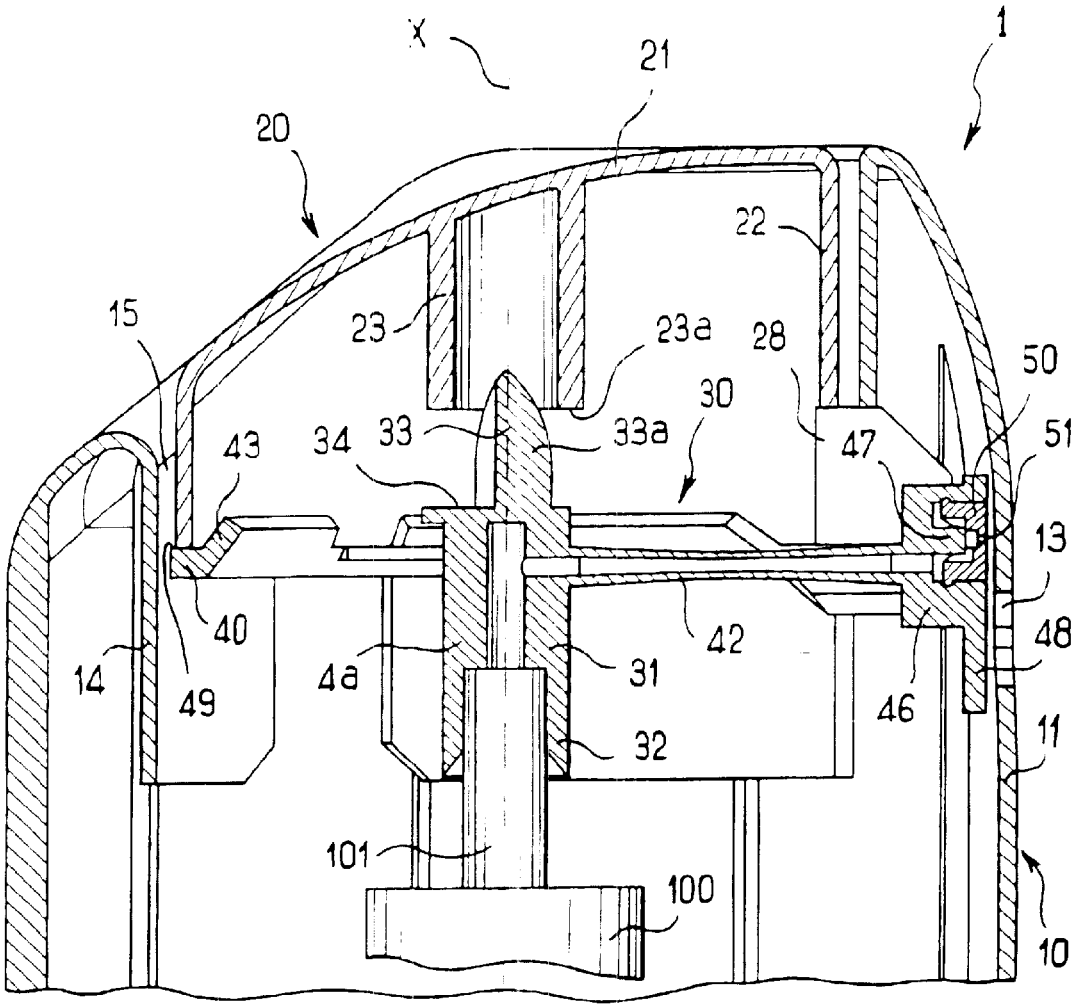
FIG. 6 shows another variant in which the dispenser element is a pump.

By way of example, FIG. 6 shows a variant comprising a pump 100 having a control rod 101 similar to the valve rod 4 as described above.

Figure 7:
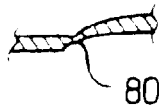
FIG. 7 is a diagrammatic fragmentary view showing how the cover and the pushbutton can be molded as a single piece.

The pushbutton and the cover can be made, for example, in the form of a single molding; the pushbutton being connected to the cover by means of a hinge 80 as shown in FIG. 7, according to one aspect of the invention.

Throughout the description, including in the claims, the term "comprises a" should be understood as being synonymous with "comprises at least one", unless specified to the contrary.

What is claimed is:

1. A dispenser device comprising:

a cover comprising an opening;

a dispenser endpiece movable relative to the cover and comprising:

a dispenser orifice; and a duct for conveying a substance flowing from a dispenser element towards the dispenser orifice;

a pushbutton movable relative to the cover and operative to act on the dispenser endpiece and thereby actuate the dispenser element, the cover being configured to mask the dispenser orifice when the pushbutton is at rest so as to enable the dispenser orifice to take up a position facing the opening of the cover when the pushbutton is depressed in order to actuate the dispenser element, the pushbutton being configured to do the following when it is actuated to dispense the substance:

act in a first stage to move the dispenser orifice relative to the cover in such a manner that the dispenser orifice comes into register with the opening of the cover, the duct of the dispenser endpiece being suitable for deforming so as to enable the dispenser orifice to move without actuating the dispenser element during this first stage; and thereafter, in a second stage, actuate the dispenser element.

2. A device according to claim 1, wherein the dispenser endpiece comprises:

a peripheral portion relative to which the dispenser orifice is stationary;

a central portion co-operating with the dispenser element; and an elastically deformable intermediate portion interconnecting the central and peripheral portions.

3. A device according to claim 2, wherein the intermediate portion comprises flexible bridges of material.

4. A device according to claim 3, wherein the duct is at least partly within one of said bridges.

5. A device according to claim 3, wherein at least one of the bridges comprises a right section that is substantially rectangular, wherein the right section comprises a long side substantially perpendicular to a displacement direction of the dispenser endpiece for actuating the dispenser element.

6. A device according to claim 3, wherein the intermediate portion comprises three bridges disposed at substantially 120° from one another.

7. A device according to claim 2, wherein the pushbutton is configured to entrain movement of the peripheral portion during the first stage without entraining movement of the central portion, and then during the second stage to entrain movement of the central portion.

8. A device according to claim 2, wherein the force exerted by the intermediate portion on the central portion when the pushbutton begins to be released while the dispenser element is still in the dispensing position is less than the force exerted by the dispenser element on the central portion to return the dispenser endpiece to its initial state.

9. A device according to claim 2, wherein the central portion, the intermediate portion, and the peripheral portion are connected into a single piece by molding material.

10. A device according to claim 2, wherein the pushbutton side of the peripheral portion comprises at least one stiffening rib oriented obliquely towards the inside of the device, and wherein the pushbutton comprises a skirt configured to press via its free edge on an abutment surface situated radially outside the rib.

11. A device according to claim 2, wherein the pushbutton side of the central portion comprises a projecting element, and wherein the pushbutton comprises a skirt which the projecting element can engage, the skirt being configured to press via its free edge on an abutment surface of the central portion and thereby surround the projecting element.

12. A device according to claim 1, wherein the dispenser orifice comprises a nozzle comprising swirling channels.

13. A device according to claim 1, wherein the dispenser endpiece comprises a wall that is in register with the opening in the cover when the pushbutton is at rest.

14. A device according to claim 1, wherein the dispenser element comprises a control rod.

15. A device according to claim 1, wherein the dispenser element comprises a valve.

16. A device according to claim 1, wherein the dispenser element comprises a pump.

17. A device according to claim 1, wherein the cover and the pushbutton are connected into a single piece by molding material.

18. A device according to claim 17, wherein the cover and the pushbutton are operatively connected by a hinge.

19. A receptacle comprising the dispenser device of claim 1.

20. A receptacle according to claim 19, further comprising a valve comprising a valve rod, wherein the substance is dispensed through the valve rod when the valve is actuated.

21. A receptacle according to claim 20, wherein the valve is actuated by axial displacement of the valve rod, the axial displacement being not greater than 2 mm.

* * * * *